United States Patent [19]

Sommer et al.

[11] 4,173,874

[45] Nov. 13, 1979

[54] APPARATUS ON A TEXTILE MACHINE FOR THE FEEDING OF YARNS, SLIVERS OR OTHER FIBRILLAR MATERIALS

[75] Inventors: Werner Sommer, Esslingen; Antonius Vinnemann, Stuttgart; Manfred E. Walter, Grötzingen; Willi G. Gaiser, Gäufelden; Heinrich K. Elsässer, Stuttgart; Wolfgang A. A. Brenner, Schlierbach; Hermann Kress, Filderstadt, all of Fed. Rep. of Germany

[73] Assignee: Sulzer Morat GmbH, Filderstadt, Fed. Rep. of Germany

[21] Appl. No.: 869,757

[22] Filed: Jan. 16, 1978

[30] Foreign Application Priority Data

Jan. 17, 1977 [DE] Fed. Rep. of Germany ..... 2701652

[51] Int. Cl.[2] ..... D04B 3/06; D04B 15/48; D04B 27/10; D04B 35/00

[52] U.S. Cl. ..... 66/125 R; 66/64; 66/84 A; 139/224 R

[58] Field of Search ..... 66/125, 84 A, 64; 139/436, 224 R

[56] References Cited

U.S. PATENT DOCUMENTS

| | | | |
|---|---|---|---|
| 3,446,038 | 5/1969 | Inui | 66/84 A UX |
| 3,593,394 | 7/1971 | Bolles | 66/84 A |
| 3,703,818 | 11/1972 | Umeda et al. | 66/125 |
| 3,707,083 | 12/1972 | Svoboda | 66/125 |
| 3,732,896 | 5/1973 | Jekl et al. | 139/224 X |
| 3,751,944 | 8/1973 | Krause | 66/64 |
| 4,034,783 | 7/1977 | Pech et al. | 139/436 |
| 4,081,001 | 3/1978 | Borodin et al. | 139/436 |

*Primary Examiner*—Ronald Feldbaum

[57] ABSTRACT

Apparatus for feeding yarn, sliver or fibrous materials wound on stationary supply packages to a texile machine, comprising a plurality of movable material transporting elements and a plurality of movable material laying-in elements for feeding the materials from the supply packages to the textile machine, endless tracks defining working and return sections for said transporting elements and working and return regions for said laying-in elements, said transporting elements and said laying-in elements running in series on said endless tracks, and entwining of the materials during successive runs of said elements on said tracks is avoided by at least one deflection element by means of which the materials are fed via said transporting elements to said laying-in elements, during successive runs thereof through the working region, alternately from one and another side of a surface laid through the working region of said laying-in elements and the return section of said transporting elements.

27 Claims, 15 Drawing Figures

APPARATUS ON A TEXTILE MACHINE FOR THE FEEDING OF YARNS, SLIVERS OR OTHER FIBRILLAR MATERIALS

The invention relates to an apparatus on a textile machine for the feeding of yarns, sliver or fibrillar materials, wound on stationary supply packages, comprising: a support containing a plurality of material guiding means; a plurality of movable material transporting elements and a plurality of material laying-in elements, where the materials are fed from the supply packages via the guiding means to the movable elements and laying-in elements; endless tracks for the movable elements and the laying-in elements to allow the movable elements and laying-in elements to travel in sequence through working and return sections and/or working and return regions, and a means for avoiding entwining of the materials, by means of which the material sections, located between the movable elements and the guiding means, are fed on endless paths.

Certain textile machines, e.g. flat knitting machines with carriages revolving around an endless track (Dt. OLS 15 85 454), circular knitting machines with revolving cam boxes (Dt. OLS 25 40 498), warp knitting machines or undulating shed weaving machines (Dt. OLS 24 50 020) having endless rotary tracks for a number of yarn guides/feeders. To prevent the numerous yarns becoming entwined/entangled with each other due to the constant revolving motion of the yarn guides, every yarn guide is attached to a frame, which also supports a supply package, a yarn eyelet, a clamping device and in some cases, also a cutting device, so that several units, comprising each a yarn guide, an eyelet, a supply package, a clamping device and a cutting device, have to revolve in sequence around a common endless rotary track.

A disadvantage of such a yarn guide system is that only relatively few of the said units can be arranged on the textile machine and empty supply packages can be changed only when the textile machine is stopped, as a result of which, production is lost.

Apparatus are known of the abovementioned type (Dt. OLS 20 64 227 and 23 51 741), having stationary supply packages for the yarns to be fed to a knitting, warp-knitting or weaving machine. To prevent entwining of the yarns, a rotary track in a figure of eight is provided for the yarn guides, clamping devices and laying-in elements.

A disadvantage of such a design of rotary track is the situation that the yarn sections located between the yarn guides and the eyelet support are so severely entwined, just at the point when the yarns are knitted into stitches or for some other reason, are withdrawn from the supply packages, that the yarns are in mutual contact and rub together, because only the laying-in elements of those yarns whose yarn guides are passing through the mmiddle section of the rotary track, are arranged in their working region and can consequently be used for laying-in yarn to the machine. The consequence of this is differing yarn tensions and even damage to the yarns when being withdrawn from the supply packages and this has to be avoided.

This also leads to a further disadvantage that the space above the needle beds is no longer accessible, thus making it difficult to work on the machine.

Corresponding disadvantages result when using the known yarn guide system on circular knitting machines and other stitch-forming machines, warp knitting machines and weaving machines or other yarn, sliver or fibrillar materials, e.g. glass fibres, metal wires or the like.

The aim of the invention is therefore to improve the abovementioned apparatus such that the materials are withdrawn from the supply packages only when they are in a low degree of entwining and do not make mutual contact, but not such that this implies stopping the textile machine. In addition, the yarn guide system should be designed such that it requires the least possible space in the direct vicinity of the textile machine, and offers least possible hindrance to working on the machine.

To resolve these problems, the invention proposes the characterising features wherein the means for avoiding entwining of the materials consists of at least one deflection element, by means of which the materials are fed to the laying-in elements during the successive runs thereof through the working region, alternately from the one and the other side of a surface, laid through the working region of the laying-in elements and the return section of the movable elements.

The invention is based on the knowledge that by alternately feeding the materials from the one or other side of the said surface, it is possible to prevent both the entwining as well as the figure of eight track for the material guides.

The invention offers additional advantages, the greatest being that the materials cannot come into mutual contact, even when using a large number of yarns and when using a stationary eyelet carrier, when the yarns are being withdrawn from the supply packages and fed to the textile machine. Another advantage is that a compact, space-saving arrangement is afforded, requiring little space, particularly in the vicinity of the working region of the laying-in elements, which has to be kept clear for working on the textile machine. Finally, a circular rotary track is advantageously more operationally reliable and cheaper, because stationary guide rail systems or simple rocking levers, attached to the material guides, can be provided for feeding the material sections between the material guides and the eyelets.

The apparatus according to the invention can be used to particular advantage on knitting machines as proposed in the Dt.OLS 25 31 762.

Further advantageous features of the invention are characterised in the sub claims. The invention will now be described in greater detail in conjunction with drawings and various embodiments.

Figure 1:
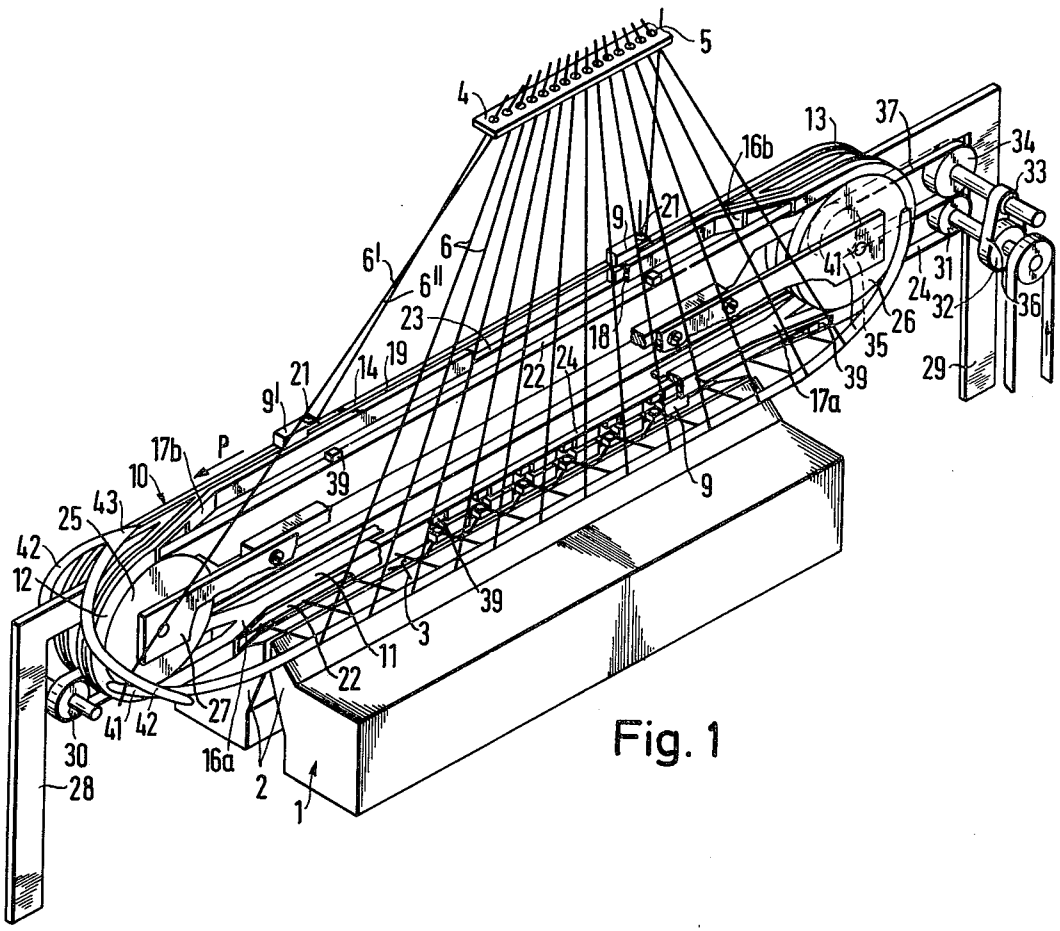
FIG. 1 is a schematic view in perspective of a yarn guide system according to the invention, for a flat bed knitting machine.

FIG. 1 shows the yarn guide system according to the invention, in conjunction with a flat bed knitting machine as proposed in Dt. OLS 25 31 762. It comprises a frame 1 with two needle beds 2 in V-shape arrangement, along the tracks of which, in known manner, knitting needles, preferably latch needles, can be moved. The knitting needles 3, when all are advanced fully, describe a cross-shaped working region, running parallel to the needle beds 2 and immediately above the knitting needles 3. The yarn laying-in elements have to be transported along this working region so that the yarns are gripped by the knitting needles 3 and processed into stitches. The remaining details of the flat bed knitting machine, not necessary for the understanding of the invention, can be obtained from the Dt. OLS 25 31 762.

Above the machine, provision is made for a stationary eyelet carrier 4, arranged preferably parallel to the working region of the laying-in elements, and through the eyelets 5 of which, several yarns, slivers or other fibrillar materials, e.g. yarns 6 are fed from stationary supply packages (not illustrated) to a number of material guides 9, which revolve on an essentially circular, endless rotary track 10. The rotary track 10 has a single-track working section 11, arranged parallel to the working region and close above it, and a length somewhat larger than this. The two ends of the working section 11 are connected with the two ends of a two-track section 12 and 13, which are curved upwards through about 180°. In the manner shown in FIG. 1, the two ends of each two-track section 12 and 13, are each connected to an end of a return section 14, running parallel to the working section 11, said return section 14 being arranged in the space between the working section 11 and the eyelet carrier 4 or the line defined by the eyelets 5. The connection between the working section 11 and the return section 14 with the sections 12 and 13, each consist of a branch 16*a*, 16*b*, 17*a* and 17*b*, such that the branches 16*a*,*b* divert all the yarn guides 9, transported in the direction of the arrow P and entering on one of the two tracks of a two-track section 12 or 13, to the working section 11 or to the return section 14, while the branches 17*a*, *b* are in the form of shunts, so that each yarn guide 9, entering from the working section 11 or from the return section 14, is diverted alternately to one of the two tracks of sections 12 and 13. The yarn guide designated 9′ in FIG. 1, thus successively passes through the front track of section 12 in FIG. 1, the working section 11, the front track of section 13, the return section 14, the rear track of section 12, the working section 11, the rear track of section 13 and again through the working section 14. Similarly, all the yarn guides 9, following the guide 9′, are moved in this manner.

The working section 11, the two tracks of sections 12 and 13, the return section 14 and the branches 16 and 17, according to FIG. 1 may all be made of tubes 18 with rectangular or square cross section, having an elongated slot 19 at their external perimeter and converging in the region of the branches 16 and 17. In the tubes 18, the yarn guides 9 are guided with components having external sections corresponding to the inner sections of the tubes 18, with necks to protrude through the slot 19, the said necks having broader headpieces attached to them outside the tube 18, and these headpieces being fitted with laying-in elements 21, e.g. a yarn eyelet.

The yarn guides are driven by three endless, flexible belts 22,23,24, arranged in parallel. The belts 22 and 23 are each supported by pairs of coaxial deflector wheels 25,26 and arranged with the tube 18 of the two-track sections 12 and 13, such that the upper run of the belt 23 is located also in the tube 18 of the return section. The tubes 18 are open on the inside in the region of the sections 12 and 13, so that the belts 22 and 23 can run on the deflector wheels, while the tube 18 has lateral openings in the region of the branches 16 and 17, so that the belts 22 and 23 can run in and out in the manner shown in FIG. 1. The shafts of the deflector wheels 25 and 26 are rotatably mounted in rails 27 arranged on both sides of the rotary track 10, and the rails 27 support all the components arranged within the revolving yarn sheet. The overall rotary track 10, including the deflector wheels 25 and 26 is supported on two support systems 28 and 29, which engage the shafts between each pair of deflector wheels 25, 26. The belt 24 is carried on two deflector wheels 30 and 31, mounted externally of the rotary track 10 on the support systems 28 and 29. The deflector wheels 30 and 31 are smaller in diameter than the deflector wheels 25 and 26, and are arranged such that on one hand, the lower run of the belts 22,23,24 run on one plane and on the other hand, the lower run of belt 24, is arranged between the two lower runs of belts 22, 23 and in the tube 18 of the working section 11.

On the shaft of the deflector wheel 31 is mounted a drive roll 32, which is coupled via a transmission gear, comprising two more rolls 33, 34, to a roller 35, attached to the shaft of the deflector wheel 26, and two belts 36, 37 running about these rolls, so as to drive the deflector wheels 26. The drive roll 32 and its shaft is connected with a drive mechanism (indicated schematically). Because of the transmission, the belt 24 runs at a slower speed than belts 22, 23.

On the exterior faces of belts 22,23,24 pawls are provided 39, which fit into the tubes 18 and make contact with and entrain the sections of the yarn guides 9, also in the tubes 18. In the region of the branches 16*a*, the two tubular tracks 18 are curved inwards, with the result that the yarn guides are deflected inwards, so that they slide off belt 22 and 23 and are pushed more and more on to the belt 24, until they leave the effective range of the motivating pawls 39 of the belt 22 or 23, and come into range of a pawl 39 of belt 24 to be further conveyed at a relatively slower speed. In the region of the branch 16*b*, the tube 18 of the front track of section 13 in FIG. 1, is bent backwards, so that all the yarn guides 9, fed from section 13, are entrained by the pawls 39 of belt 23 through the return section 14. Similarly, the yarn guides 9 in the branch 17*a*, are diverted to the one or other track of section 13 or from the belt 24 to one of the belts 22 and 23, and are returned by this at a relatively higher speed to the start of the working section 11, lying on the left in FIG. 1, such that the yarn guides are pushed by the belt 23 in the branch 17*b*, on to belt 22, or by the belt 23 which passes through the rear track of section 12, in FIG. 1. When passing through the branches 16*b* and 17*b*, the yarn guides 9 may possible change from belt 22 to belt 23 or vice versa, but do not change their speed because these belts revolve at the same speed. To facilitate the transfer of the yarn guides from one belt to the other in the region of the branches 16*b*, 17*b*, a fourth belt can be provided between belts 22 and 23, which would revolve slightly faster than the belts 22 and 23.

Figure 2:
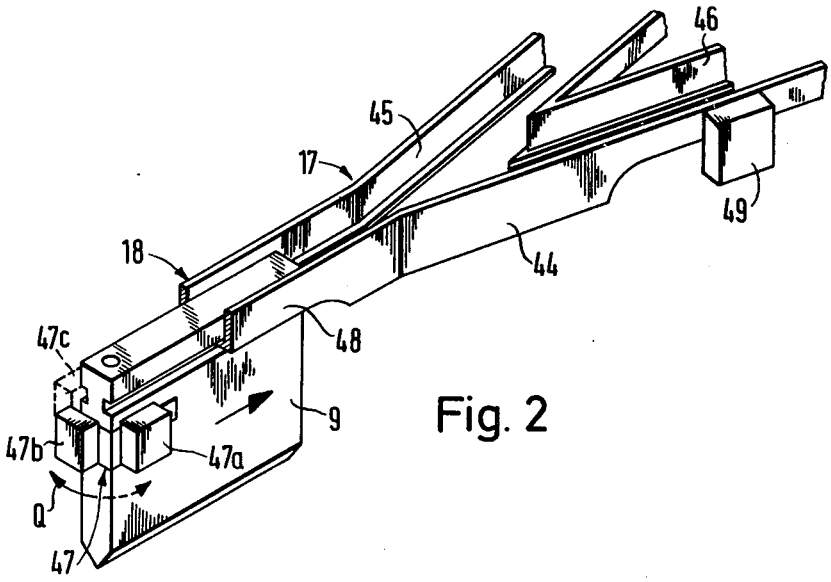
FIG. 2 shows details of the shunt arrangement required for the yarn guide system of FIG. 1.

The choice of track of sections 12 and 13, into which one yarn guide 9 should enter after the branch 17*a* or 17*b*, is made for example, by means of a shunt arrangement, which is illustrated schematically in FIG. 2. The side walls of the tube 18, connecting with the working section 11, change in the region of the branch 17, into vertical guide rails 44 and 45, which divert from each other in a V-shape. Into the opening thus formed, there penetrates the tip of a V-shaped guide section 46, which functions together with the guide rails 44 and 45 in such a manner that the yarn guides 9, diverted forwards or backwards attain the two tracks of the end 13, which are connected to the guide rails 44 and 45 or the guide section 46.

On each yarn guide 9 is pivotably mounted a storage device 47, comprising two pawls 47*a* and 47*b*, which between them form an angle of about 90° for example, and in FIG. 2 are shown to pivot jointly in the direction of the arrow Q. In the position shown in FIG. 2, the pawl 47*b* is in the non-working position and the pawl 47*a* is in the working position, in which it is arranged essentially parallel to and at a slight distance from the yarn guide 9. As a result, when the yarn guide 9 enters the branch, an extension 48, provided on the guide rail 44, enters the slot between the upper section of the pawl 47*a* and the yarn guide 9, so that the yarn guide 9, during its further movement, is drawn through the guide rails 44 into the front track of the end 13. If the storage device 47, before entry of the yarn guide 9 into the branch 17 were however to be tilted through about 90° and thus so arranged that the pawl 47*a*, were in the non-working position or in the position assumed by the pawl 47*b* in FIG. 2, and that the pawl 47*b* assumes the broken line position 47*c* in FIG. 2, and hence in its working position, then the yarn guide 9, when passing through the shunt arrangement would be drawn correspondingly from an extension of the rail 45 and by the pawl 47*b* on to the rear track of the end 13. Thus each storage device 47 represents an information store, the pivot position of which possesses information on which side the relevant yarn guide 9 has to be diverted when entering the branch 17, while the extensions 48 are also scanning elements which call up the information stored in the storage elements, 47.

The production of the desired pivot position of the storage element 47 should take place at latest shortly before entry of the relevant yarn guide 9 into the working section are since in the working section 11 it is no longer possible by simple means to effect a decision between the desired pivot position and the pivot position still available from the preceding revolution. However, the information change can also be undertaken immediately after passage of the yarn guide 9 through the branch 17.

According to FIG. 2, the information change of the diversion of the storage element 47 may be undertaken by means of a stop 49, fitted downstream of the branch 17 and which is fitted to the rails 44 or 45 at such a height that the pawls 47*a* and 47*b* of all passing yarn guides 9, strike against the stop 49 and thus become tilted through 90° in the direction of the arrow Q, so that the yarn guides, when entering the next shunt become entrained by other pawls. By fitting a stop 49 behind each of the branches 17*a*, 17*b* the yarn guides 9 can be deflected in each branch 17*a*, 17*b* into the desired track, without the need for special elements being required for this purpose, which have to be controlled from outside the rotary track or have to be tripped within intervals of time corresponding to the distance between two yarn guides 9.

Due to the yarn guides 9 passing through the branch 17*b*, which represents a diversion element, the associated yarns 6 are automatically arranged on the one or other broad side of the rotary track 10 and thus fed alternately to the laying-in elements 21 from the one and other side of a plane laid through the working region of the laying-in elements 21 and the return section 14 of the yarn guides 9. In order also to ensure this distribution of the yarns when the eyelet carrier 4 is not arranged parallel to the working region and exactly above it and to prevent the yarns coming into contact with the rotary track 10 or other parts, when their yarn guides 9 pass in series through the section 12, the working section 11 and the section 13, a guide rail system is provided preferably at both sides of the rotary track 10, consisting of an essentially linear guide rail 41, attached to the rail 27 and extending parallel to the working section 11, and a curved guide rail 42, attached to the support construction 28 and extending essentially parallel to the section 12. The ends of the guide rails 41 are curved upwards slightly, in the manner shown in FIG. 1, and the left end (FIG. 1) is overlapped with the corresponding end of the guide rail 42, to form a passage gap for the yarns 6. The upper end of the guide rail 42 (FIG. 1) is also curved towards the middle of the rotary track 10 and connected with the corresponding end of the guide rail 42, arranged on the other side of the rotary track 10, so as to form a point 43, lying exactly in the middle between the two tracks of the upper end of section 12. As a result, the yarn 6' fed by yarn guide 9' runs on to the front guide rail 42 (FIG. 1), is fed as far as the access slot on its inside, then passes the access slot and then runs on to the outer surface of the front rails 41 in FIG. 1, which is indicated in FIG. 1 for the yarn 6''. From the guide rail 41, the yarn is then kept out of contact with the rotary track 10 until it moves off the guide rail 41 in the region of the deflector wheel 26.

The operation of the described yarn guide system is as follows: Under the assumption that the yarns 6 are arranged side by side in the eyelet carrier 4 according to FIG. 1 and without making contact, all the yarns guided on the straight section of the guide rail 41 can be used for knitting and fed at knitting speed, because the corresponding laying-in elements simultaneously pass through the working range and the yarns 6 can therefore be presented to the knitting needles 3 via the laying-in elements 21. The corresponding yarn guides 9, to which the laying-in elements 21 are rigidly attached, according to the embodiment shown in FIG. 1, move simultaneously on the working section 11, which in this embodiment, is arranged parallel to and vertically above the working region of the laying-in elements 21.

At the end of the working region and of the working section 11, which in FIG. 1 corresponds roughly to the end of the needle beds 2, the yarns 6 ar cut by means of a cutting device associated individually with the yarn guides 9 or provided at the end of the needle beds, and at the same time, clamped with a clamping device fitted in each yarn guide 9. Thereafter, the yarn guides 9, run into the front track of the end 13, e.g. as in FIG. 1, and are moved on this track at greater speed as far as the branch 16*b* and hence to the branch 17*b*, during which time the yarns twist about themselves through 180°. With the entry of the first yarn guide 9 (depicted in FIG. 1 on the extreme right) into the branch 17*b*, the last yarn guide, rotating on the track 10 will have just passed the branch 17*b* in the direction of the front track of the section 12, so that the first yarn guides pass the branch 17*b* in the direction of the rear track of section 12, and are guided around the deflector wheel 25 as far as the branch 16*a*. During this movement, its thread lies against the rear guide rails 42 and 41 so that this yarn emerges from the entwined yarn sheet of the yarns running behind it and is no longer in contact with any yarn. After the yarn guide 9 relevant to this yarn has passed the branch 16*a*, and therefore is again driven by the belt 24 at knitting speed, its yarn can be released from the clamping device and can again be presented to the knitting needles. The same applies to the following yarns, all of which have no mutual contact on the rear guide rail 41. When again reaching the branch 17*a*, all yarn guides are diverted to the rear track of the section 13. Those yarn guides which have reached the end of the working section 11, will therefore be returned along a return section 14, which lies in a space, bordered by the drive section 11 demarcated by the line formed by the eyelets 5 and the guide rals 41 and 42.

Various modifications are possible to the rotary track 10 illustrated in FIG. 1. For instance, it is not essential that the yarn guides 9 be returned at high speed to the start of the knitting after the cutting and clamping of the yarns. One advantage of this measure is however, that only a few more yarn packages are required for the knitting process, than the number of yarn guides 9 which can be arranged along the working region.

It is also not essential to design the working section 11 as a single track. It is in fact possible to provide a two-track working section 11, along the two tracks of which the yarn guides could move alternatively. The laying-in elements could be the outlet ends of small tubes attached to the yarn guides either so as to be flexible or such that they can pivot. These tubes would protrude downwards when the yarn guides are on the working section 11 and with the aid of at least one additional guide rail attached to the rail 27, could be bent or tilted so that their outlet ends are moves at that time independently of which track of the working section 11 the yarn guides are travelling on, i.e., they are moved along a line in the middle above the knitting needles 3. The working section for the yarn guides would, in this case, be at a comparatively large distance from the working region of the laying-in elements. Even with this embodiment, the yarn guides and the yarn sections between them and the eyelets 5, would have to be returned along a return section, which would lie in the space, formed by the working working region of the yarn guides, the eyelets 6 and the guide rails 41 and 42, in order that the yarns 6 could be fed alternately from the one or other broad side of the rotary track 10.

A particular advantage of the rotary track 10 is that it can be arranged in an essentially vertical position between the needle beds 2 and the eyelet carrier 4, so that the working region of the laying-in elements 21 and the needle beds 2 are easily accessible.

Further possible modifications to the embodiment according to FIGS. 1 and 2 exist in that one of the two rapidly revolving belts 22 and 23 may be omitted. Instead, the deflector wheels 25 and 26, associated with the omitted belt, can be designed such that they take over (in the branches 16 and 17) either the yarn guides fed from one of the two remaining belts, or they transfer the entrained yarn guides to one of these belts. Similarly, the working section 11 could have associated with it the one run of a slowly revolving belt and the return section 14 could have associated with it the one run of a fast revolving belt, while the deflector wheels 25 and 26 take over the transport of the yarn guides in the deflection region and hence the function of the section 12 and 13, so that alternately, the front and back deflector wheels 25 and 26 come into use.

Figure 3:
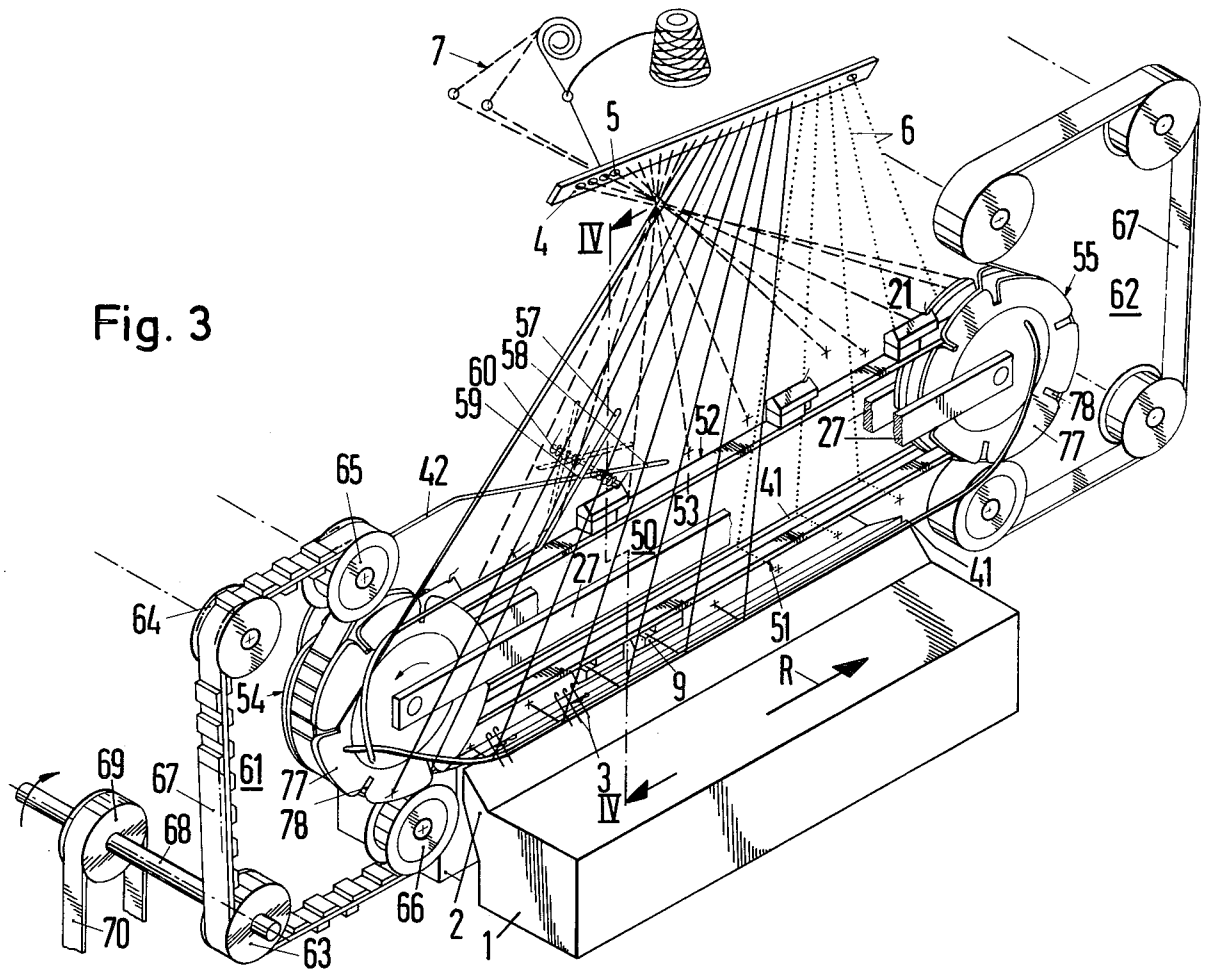
FIG. 3 is a schematic diagram in perspective of another embodiment of the yarn guide system according to the invention.
Figure 4:
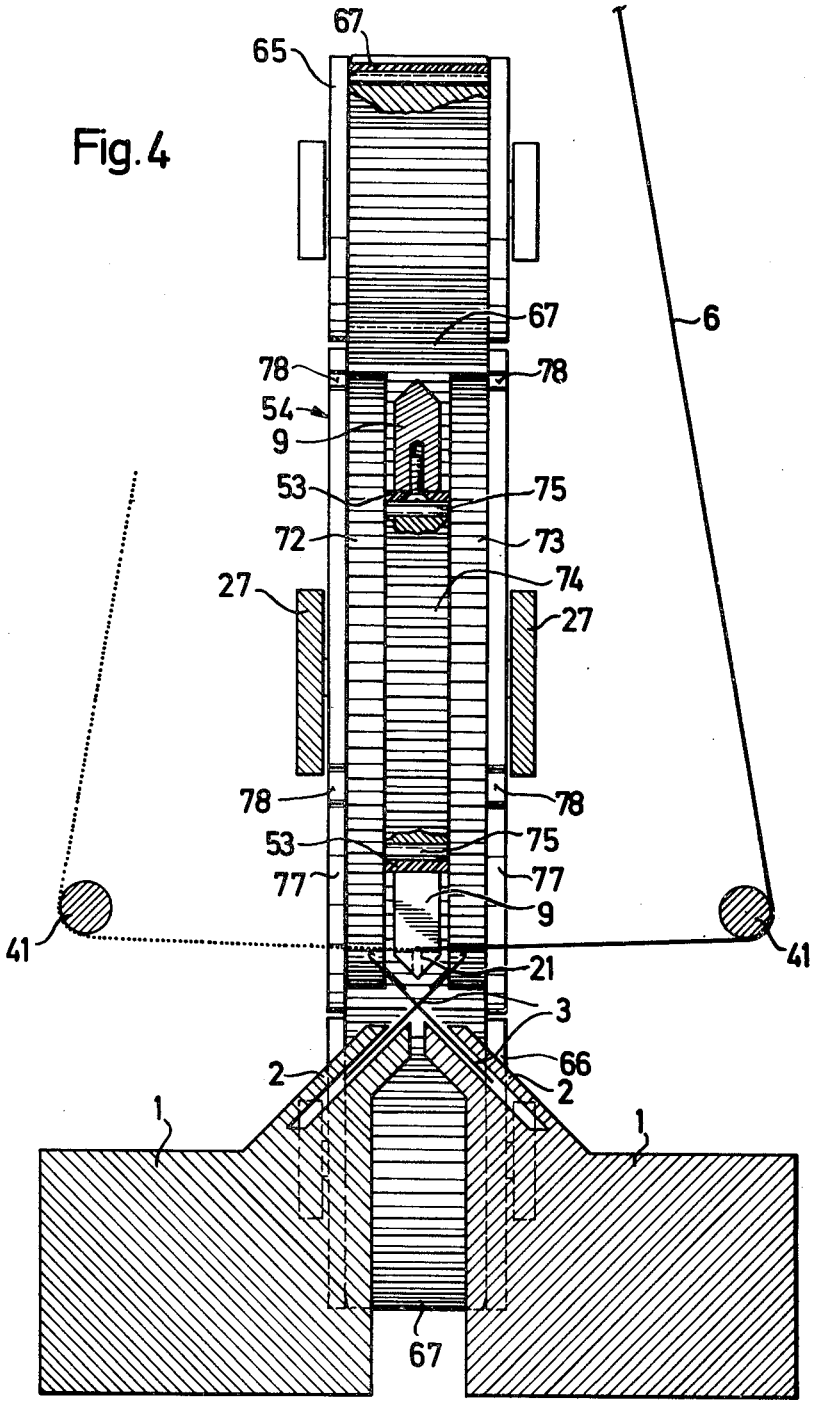
FIG. 4 is a section along the line IV—IV of FIG. 3, indicating the possibility of deflecting the yarns.
Figure 5:
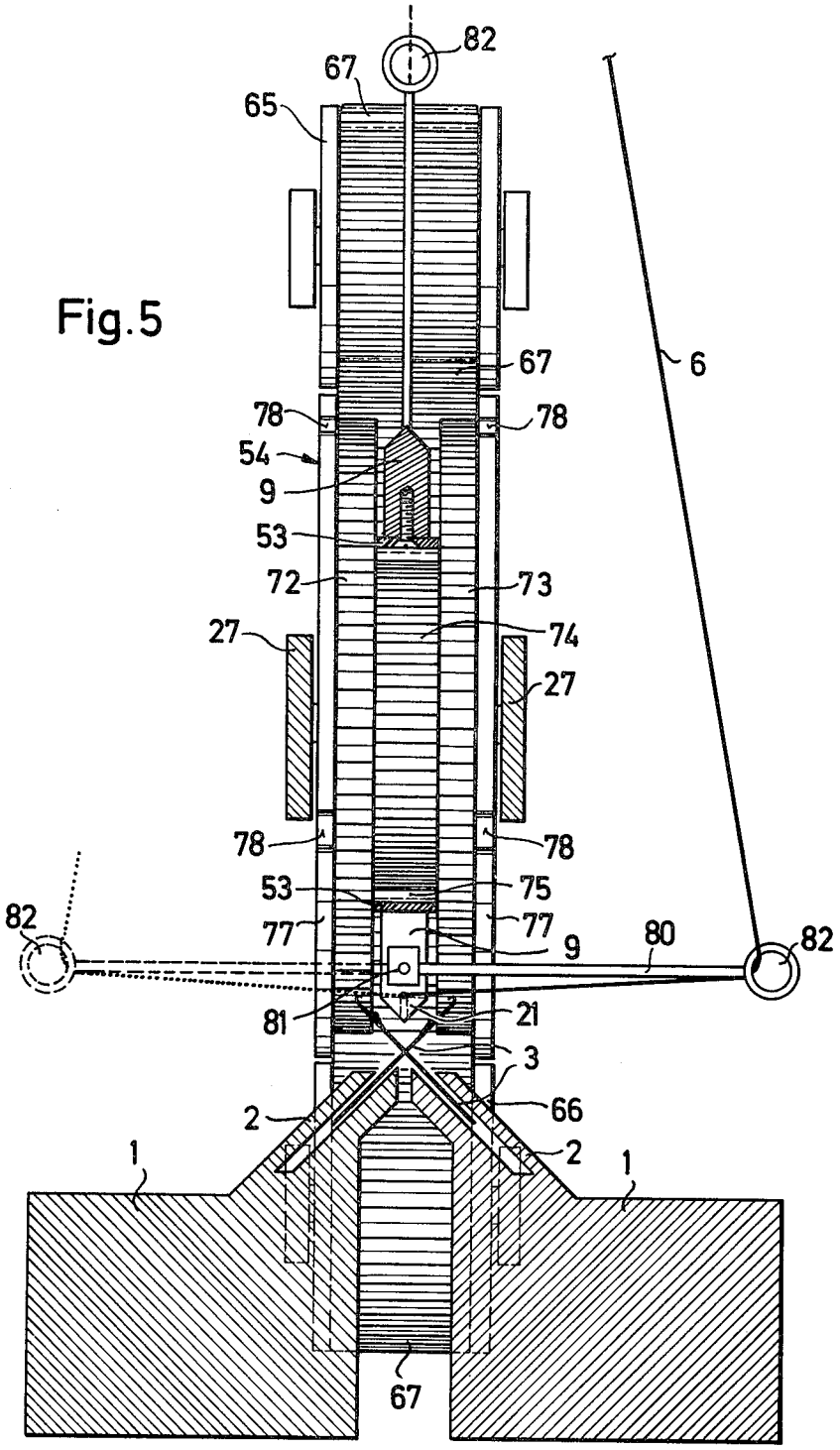
FIG. 5 is a corresponding section of FIG. 4, showing an alternative method of diverting the yarns.

FIGS. 3 to 5 show another embodiment of the invention. In addition to the embodiment according to FIG. 1, a further yarn storage device 7 for each yarn 6 is indicated above the eyelet carrier 4, the function of said storage device 7 being explained below.

To prevent entwining of the yarns 6, provision is made for an endless, circular rotary track 50 for the yarn guides 9. The track 50 incorporates a working section 51, a return section 52 and two sections co-joining these, such that the working section 51 lies above the working region of the laying-in elements 21. The return section 52 is arranged between the working section 51 and the eyelet carrier 4. The rotary track 50 is formed by an endless flexible belt 53, to which the yarn guides 9 are attached, and by two deflector wheels 54 and 55, the axes of which are mounted at the ends of the rigid rail 27. To achieve that the yarns 6 (during the repeated revolving of the yarn guides 9 in the direction of the arrow R) are alternately arranged on the one and on the other broad side of the rotary track 50, guide means are provided, which involve two guide rails 57, 58, converging on each other to form an entry funnel and a diverting element in the form of a shunt 59, which are connected in any desired manner with a control mechanism, e.g. via two electromagnets 60 and cables (not illustrated). The shunt 59 can be switched from the position shown in FIG. 3 by a full line, to the position indicated by a broken line, and vice versa, and the shunt serves to divert the yarns 6 alternately to the one or other side of the rotary track. As in the embodiment shown in FIG. 1, the shunt is joined by two guide rails, 42, which take over the yarns 6, diverted by the shunt 59 to the one or other broad side of the rotary track 50, and feed the yarns 6 to the guide rail 41 so as to ensure that the yarns cannot come into contact with any parts of the yarn guide system or with the knitting machine.

Contrary to the rotary track 10 of the embodiment illustrated in FIG. 1, which by virtue of its two two-track sections 12 and 13, can be firmly mounted at the two ends, the rotary track 50 has no two-track section, so that the deflector wheels 54 and 55 cannot be rigidly mounted, i.e. with a support construction engaging its axes or shafts, because the support construction in this case, makes deflection of the yarns on at least one side of the rotary track impossible. Moreover, to make any support possible at all, the invention proposes to fit support constructions 61 and 62 at each end of the rotary track 50 to provide a suspended bearing of the rotary track to act on the outer perimeter of the deflector wheels 54, 55. Each support construction 61 and 62 consists of four support rollers 63,64 65 and 66, rotatably mounted outside the rotary track 50 in a framework (not illustrated). The support construction 61 also usefully serves as the drive for the belt 53 carrying the yarn guides 9. To this end, a support belt 67 rotates about the support rollers 63–66, and rests on the outside of the deflector wheel 54 or 55, thereby supporting and driving it. The support belt 67 is preferably toothed on its outer and inner side, said toothing engaging with corresponding toothing at the exterior of the support rolls 63 to 66 and of the deflector wheels 54 and 55, thereby making slippage impossible for the support belt 67. The support roller 63 is connected with a drive mechanism, incorporating another wheel 69 attached to the shaft 68 of the support roller 63. This wheel 69 is coupled via a belt 70 or the like with the drive wheel of a drive motor.

The design of the deflector wheels 54 and 55 is shown in FIG. 4. Each deflector wheel comprises two circular discs 72, 73 about the circumference of which there runs a support belt 67, and between which a coaxial drive wheel 74 is attached for the yarn guides 9. The belt 53 runs on this drive wheel 74. The outer surface of the drive wheel 74 and the inner surface of the belt 53 may be suitably toothed 75, to prevent a slippage of the belt 53. outside diameter of the drive wheel 74 is smaller than the outside diameter of the circular discs 72,73 by an amount sufficient to allow passage of the yarn guides 9 over the deflector wheels 54,55, according to FIG. 4 in the space between the peripheral lines of the circular discs 72 and 73, and the drive wheels 74 can be completely accommodated.

To prevent the yarns 6 (after being deflected by the shunt 59, to the one or other side of the rotary track 50 and being diverted to the guide rails 42 or 41), from becoming damaged when the relevant yarn guides 9 pass the deflector wheels 54 and 55, radial slots can be provided on the outer circumference of the circular discs 72,73. Corresponding radial slots 78 (FIG. 3) are provided in the flanged discs 77, which are attached coaxially to the two outer sides of the circular discs 72, 73, and have a slightly larger diameter than the discs 72, 73, thereby preventing the carrier belt 67 slipping off.

The mode of operation of the yarn guide system as shown in FIGS. 3 and 4 is as follows: During the repeated rotation of the yarn guides 9 which, contrary to the embodiment shown in FIG. 1, can be arranged over the whole length of the rotary track 50, because this is single-track throughout, each yarn 6, after completion of one revolution of the belt 53, reaches the shunt 59, through which the yarn is alternately diverted to the one or other side of the rotary track 50.

To better understand the description, in FIG. 3, all the yarns which have been diverted to the front broad side of the rotary track 50 are indicated by a solid line, while the yarns diverted on to the rear broad side of the rotary track 50 are indicated in FIG. 3 by a dotted line. The yarns not diverted are depicted by a broken line. By omitting a section of the rail 27 in FIG. 3, the rear guide rail 41 is partly exposed. It can be seen from FIG. 3 that at the moment depicted, the laying-in elements of the two last dotted line yarns and the five first 'full-line' yarns 6 are arranged in the working region, while the relevant yarn guides 9 pass through the working section 51 whereas the dotted yarns from the rear broad side, wheres the complete line yarns are fed from the front broad side of the rotary track 50. To ensure that the knitting process proceeds quasi-continuously, i.e., takes places corresponding to the shortest distance between the yarn guides 9 in the working section 51, a total of twenty three yarns will be required so that knitting can proceed with seven yarns at any time. Although the yarn guides 9 and the laying-in elements 21 rotate on one circular track, the yarn sections located between them and the eyelets 5 cannot entwine, because the return section 52 lies between the working section and the eyelet carrier 4 and hence the return of the cut yarn ends takes place through the space bordered roughly by the working region of the laying-in elements 21, the eyelets 5 and the guide rails 41 and 42, or by those surfaces which are traversed by the yarns 6 diverted to the broad sides of the rotary track 50.

With the embodiment according to FIG. 3, the guide rails 41 and 42 can be avoided by using yarn guides 9 with rocking levers 80, according to FIG. 5. According to FIG. 5, which corresponds in all essential features to FIG. 4, the rocking levers 80 are attached to the yarn guides 9 by mens of a pivot pin 81, and the free ends are each provided with an eyelet 82 for guiding the yarns 6. When the yarn guides 9, according to FIG. 5, are on the upper run of the belt 53, the rocking levers 80 assume a vertical position, so that they, instead of the yarns 6, enter the intake funnel, formed by the guide rails 57 and 58 and are then tilted by the shunt 59 so far to the one or other side, that the yarn sections located between the yarn guides 9 and the eyelets 5 (when the relevant yarn guides 9 pass through the working section 51) are diverted alternately to the one or other broad side of the rotary track 50 and can no longer make contact with the rotary track, 50. By providing additional guide rails one can ensure that the rocking levers 80 remain in the desired tilted position and are tilted back to the vertical position when passing the deflector wheel 55. Like the yarns 6, the rocking levers 80 also enter the radial slots 77 when passing the deflector wheels 54 and 55.

Instead of rocking levers 80 with eyelets 82, one can use rocking levers in the form of tubes 83, as indicated in FIG. 3 for two yarn guides 9.

The advantage of these small tubes is that the yarns are completely protected from contact with other parts when passing the deflector wheels 54, 55. The rotary track 50 is particularly space-saving, since it is single-track and its symmetrical plane can be set in the same plane as the working region of the laying-elements 21 and the eyelets 5.

Since the distance between the yarn guides 9 and the eyelets 5 is subject to wide variation and the yarn 6 would sag severely when the yarn guides are transported from the position on the rotary track, where they are furthest away from the relevant eyelets 5, to the position with the shortest distance to the relevant eyelets 5, the yarn storage means 7 above the eyelets are preferably designed such that they hold the yarn sections, located between the yarn guides 9 and the eyelets 5, under sufficient tension, regardless of the said distances, so as to prevent sagging of the yarns.

Figure 6:
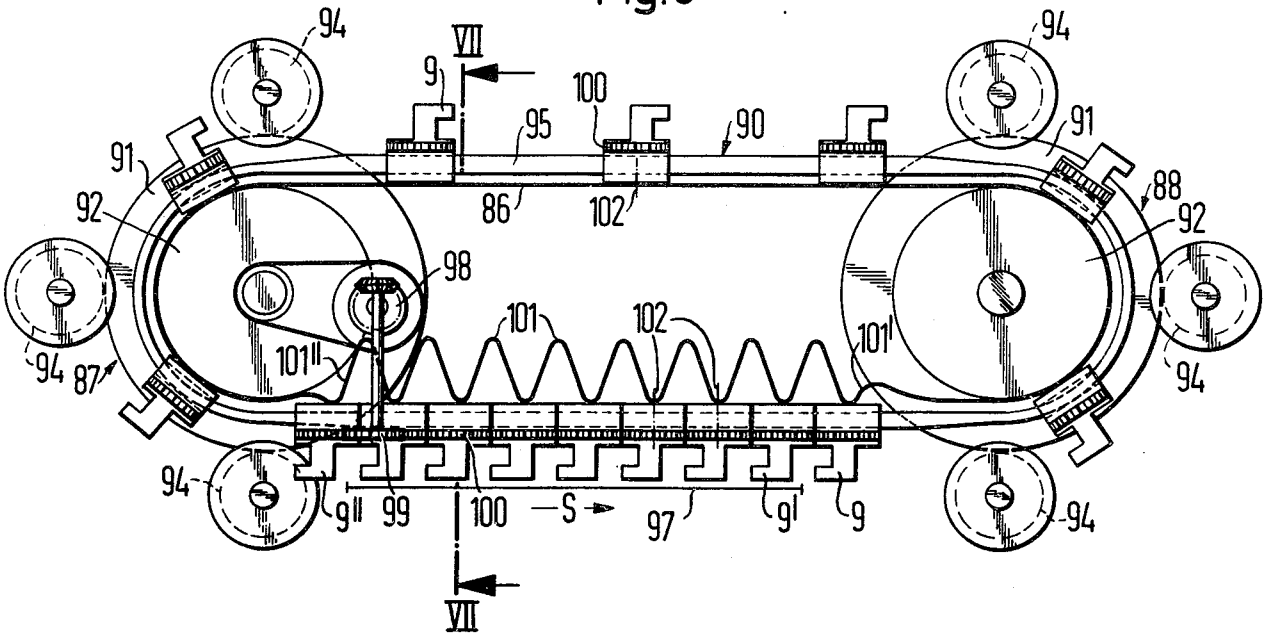
FIG. 6 shows a schematic side view of a third embodiment of the yarn guide system according to the invention.
Figure 7:
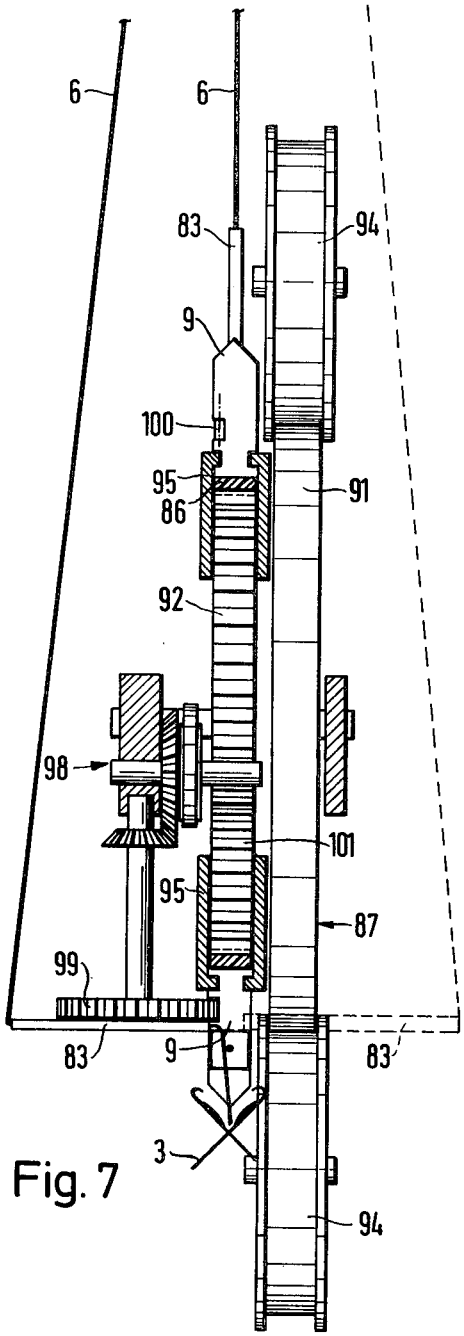
FIG. 7 shows a section along the line VII'VII of FIG. 6.

FIGS. 6 and 7 show schematically, how with the embodiment according to FIG. 3, the number of yarn guides can be reduced by simple means from twenty three to sixteen, without altering the knitting speed or the number of yarn guides involved at any one time in the knitting process. Instead of the belt 53, the yarn guides 9 can be driven by a belt 86, the length of which is considerably longer than the length of a rotary track 90 stipulated by two deflector wheels 87,88. According to the embodiment in FIG. 6, the deflector wheels 87, 88 are mounted so as to rotate, in a fixed rail (not illustrated), but in contrast to FIG. 3, comprise only one circular disc 91 of comparatively large diameter and a drive wheel 92 of comparatively small diameter, on which the belt 86 runs. The two circular discs 91 are each mounted by being suspended in a support system, which in this case, consists of three support rolls 94, rolling around the circumference of the circular disc 91 and also serve to drive it, in that at least one support roll 94 is connected with a drive mechanism. The rotary track 90 is formed by at least one circular guide rail 95 which is attached to the rigid rail connecting the two deflector rolls 87,88, and which guides the yarn guides 9 on a track, embodying a working section, a return section and two sections connecting these, such that the working section is located above the working region of the laying-in elements, indicated by the line 97 in FIG. 6.

The shaft of the deflector wheel 87 is coupled with a transmission gearing 98, to the drive shaft of which a pinion 99 is fitted, engaging with the teeth 100 on one external surface of the yarn guides 9 and driving this at a slower speed in the direction of the arrow S, compared with the speed of the belt 86. As indicated in FIG. 6, the yarn guides 9 butt against each other as long as they are in the working section, so that in this sector, the belt 86 is undulated 101, the extent of undulation depending on the belt length between the attachment points 102 of the belt 86 to the yarn guides 9. The arrangement is such that at the exit side of the working section, the belt portion, which is stored in those undulations 101', which are formed between the last yarn guides 9' still in the working section, and the preceding yarn guides no longer in the working section, is fully utilised only by the tension of the preceding yarn guides, already transported by the higher speed of the belt 86, after the yarn guides 9' have also left the working section. Similarly, the arrangement at the ingoing side of the working section is such that the first yarn guide 9'', transported at the speed of the belt 86, runs against the yarn guide already in the working section and motivated by the pinion 99, thereby forming an undulation 101'', before it (9'') itself enters the working section and is motivated by the pinion 99. This arrangement ensures that the yarn guides 9 located in the working section, are motivated at a comparatively slow speed, corresponding to the knitting speed, and are thereby spaced at the smallest possible interval, while the yarn guides outside the working section are transported at a comparatively high speed to the start of the working section and back.

Figure 8:
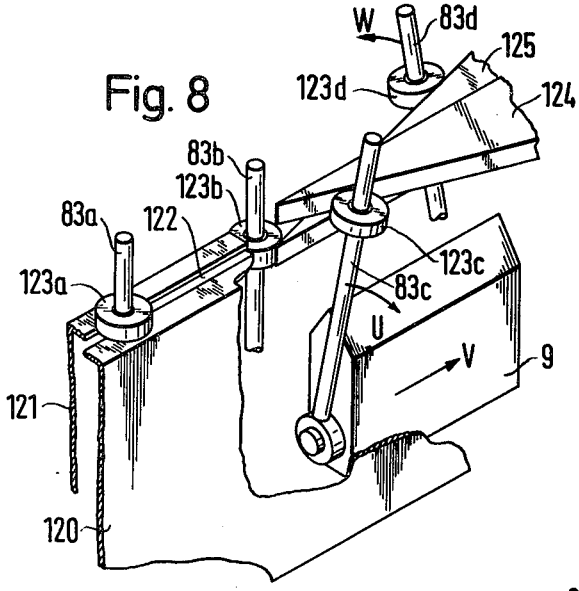
FIGS. 8 and 9 show details of a shunt arrangement which can be used in a yarn guide system according to FIGS. 3 and 5.
Figure 9:
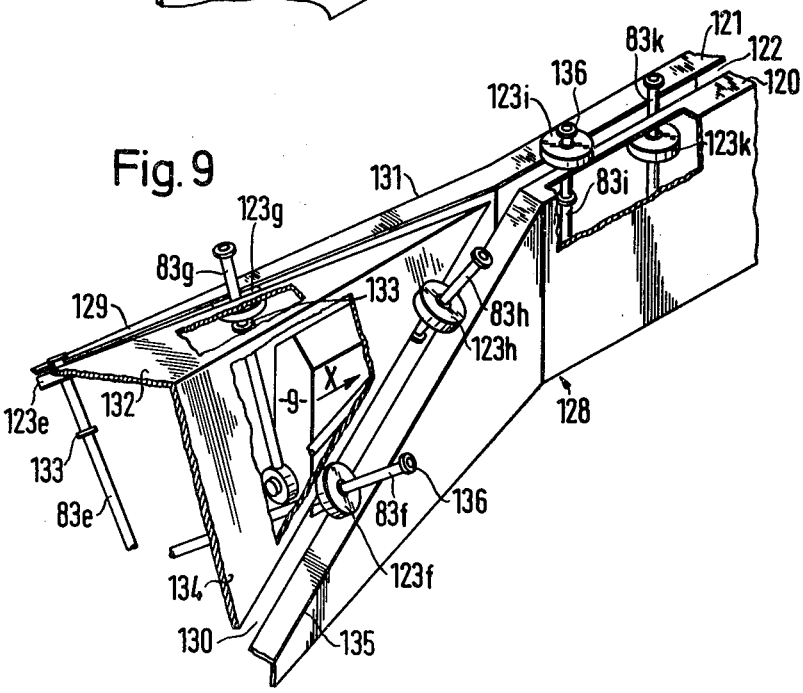

FIGS. 8 and 9 shows schematically, the manner in which the rocking levers 80, indicated in FIG. 5, and the rocking levers 83 indicated in FIG. 3, can be tilted alternately to the one or other side of the rotary track 50 without the controlling shunt 59. The four rocking levers 83*a*, 83*b*, 83*c*, 83*d*, shown in FIG. 8, are guided with a middle section in a guide groove 122, formed by two guide rails 120,121, where the guide rails 120,121 are attached above the upper run of the belt 53 (FIG. 3) to the rail 27 such that the rocking levers 83 assume an essentially vertical position. Each rocking lever 83 is fitted with a storage device 123*a*, 123*b*, 123*c*, 123*d* in the form of a circular disc/pulley or the like, mounted on the relevant rocking lever such that it can be displaced and preferably also rotated. Attachment of the storage elements 123 on the rocking levers 83 is such that the storage elements 123 can be pushed to and fro between one position above the guide groove 122, as shown in FIG. 8 for the storage device 123*a*, and a position beneath the guide groove 122, as indicated in FIG. 8 for the storage element 123*b*.

At the point where the deflection of the rocking lever 83 is desired, e.g. at the end of the upper run of the belt 53, corresponding to the end of the return section 52, the guide groove 122 is branched, where the guide rails 120 and 121 are broken off in FIG. 8 for the sake of clarity. In this branch, two deflector elements 124 and 125 are arranged one above the other so that the deflector element 124 will tilt forwards all those rocking levers 83*a* and 83*c* (FIG. 8) in the direction of the arrow U, the storage elements 123*a*, 123*c* of which slide along above the guide groove 122 in the direction of the arrow V, whereas the deflection element 125, correspondingly tilts backwards all rocking levers 83*b*, 83*d* (FIG. 8) in the direction of the arrow W, the storage elements 123*b* and 123*d* of which glide along beneath the guide groove 122. At a position, located downstream of the deflector elements 124 and 125, all the rocking levers are then taken over by the already mentioned additional guide rails, which ensure the desired pivot position of the levers 83, while the relevant yarn guides 9 are transported on the lower run of the belt 53 (FIG. 3) and the yarns 6 being carried by them are fed to the machine.

In front of the other end of the guide rails 120, 121, corresponding to the start of the return section 52, provision is made for a similar branch 128 (illustrated schematically in FIG. 9), embodying two guide grooves 129 and 130, terminating in the guide groove 122. The guide groove 129 is formed by two guide rails 131, 132, so arranged that they lie above the storage elements 123 (located in the raised position), of the rocking levers 83 entering the guide groove 129 and these storage elements 123 are lowered progressively during the further transport of the relevant yarn guides 9 in the direction of the arrow X, until the storage elements 123 rest on attachments 133 on the rocking levers 83, so that the rocking levers 83, in this position of the storage elements 123, enter the guide groove 122. FIG. 9 shows a schematic diagram of a storage element 123*e*, in the raised position but below the guide rails 132 and 131, but just entering said rails 132, 131; it also shows a storage device 123*g*, lowered almost as far as the attachment 133, and also a storage device 123*k*, gliding along beneath the guide groove 122 in its lowered position. By contrast, the guide groove 130 is formed by two guide rails 134 and 135, so arranged that they lie against the underside of the storage elements 123, located in the lowered position and associated with the rocking levers 83 entering the guide groove 130, and these storage devices 123, during the further transport of the relevant rocking levers 83 in the direction of the arrow X are raised progressively until the storage devices are located shortly before the attachment 136 of the rocker lever 83, so that the rocking lever 83, in this position of the storage devices 123 enter the guide groove 122. FIG. 9 is a schematic diagram showing a storage device 123*f*, located in the lowered position but entering above the guide rails 134 and 135; the diagram also shows a storage device 123*h* raised roughly half way, and a storage device 123*i*, gliding along above the guide groove 122 in its raised position. The guide grooves 129 and 130 or the guide rails 131, 132 and 134, 135 are furthermore so designed that in a certain inclined position, the entering rocking levers 83 are gradually tilted into the vertical position.

When using rocking levers 83 for yarn guides, according to FIG. 3, the guide grooves 129, 130 are so arranged that those storage elements 123, which according to FIG. 8, pass through the guide groove 122 in their raised position (low position), first pass through the guide groove 129 (130) according to FIG. 9, before the next passage through this guide groove 122, and are moved by this guide groove 122 in the lowered position (raised position). In this manner it is ensured that the rocking levers 83 are always alternately tilted forwards or backwards in the desired manner without externally applied tripping or control operations.

Thus, each storage device 123 represents an information store, with its raised or lowered position providing the information on which side the relevant rocking lever 83 has to be tilted when entering the branch, while the deflector elements 124 and 125 are scanning elements at the same time, and these scan the information being fed/stored in the storage elements 123.

The location of the desired raised or lowered position of the storage devices 123, should be established at latest, shortly before the relevant rocking levers 83 enter the guide groove 122, because after entry of the rocking levers 83 into the guide groove 122, it is no longer possible to differentiate, with simple means, the desired raised or lowered positions of the storage devices 123 and the raised or lowered positions still existing from the previous revolution. The change in information could be effected however immediately after passing through the branch.

Figure 10:
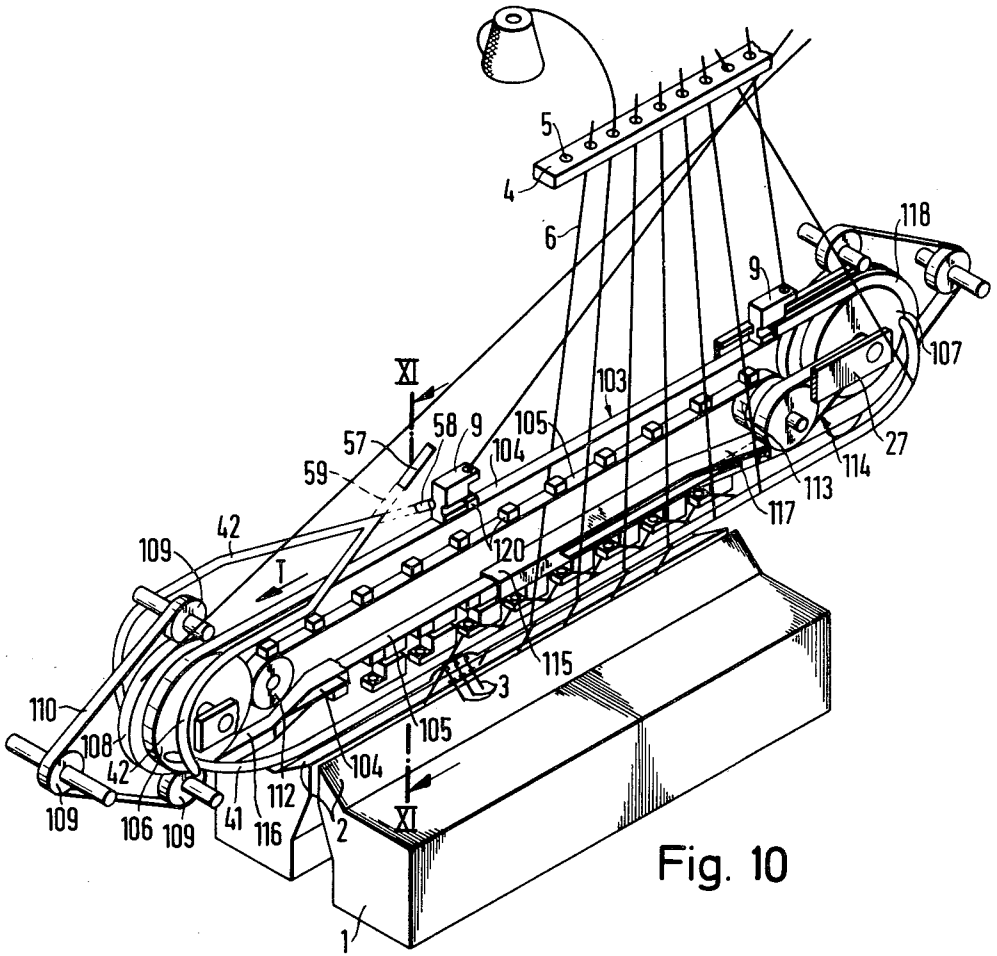
FIG. 10 is a schematic diagram of a fourth embodiment of the invention.

According to FIG. 10, the rapid return transport can be effected with the embodiment according to FIG. 3, with similar means as shown in the embodiment according to FIG. 1. To drive the yarn guides 9, revolving around the endless, circular rotary track 103, instead of only one belt 53, in this case, there are two belts 104, 105, the lower runs of which are arranged in parallel and side by side, such that the lower run of belt 105 lies above the working region for the laying-in elements. The belt 104 is supported by two drive wheels 106 and 107, to each of which is fitted, coaxially a wheel 108, provided with radial slots corresponding to FIG. 3, said wheel 108 being suspended in a support system consisting of support rollers 109 and a support belt 110. One of the support rollers 104 is connected with a drive mechanism (not illustrated) in such a manner that the support belt 110 also serves as the drive for the wheel 108 and the drive wheel 106 and the belt 104. The common axes of the wheels and drive wheels are mounted in the rigid rail 27, which also serves as the support for the bearings of two deflector wheels 112 and 113, about which the belt 105 runs. The shaft of the deflector wheel 113 is coupled via a transmission gearing 114, with the shaft of the drive wheel 107, so that the belt 105 is driven at a slower speed than the belt 104.

As in the embodiment in FIG. 1, the rotary track 103 is made up of tubular guide rails, which are depicted only partially in FIG. 10 for the sake of clarity. These guide rails extend along a straight, lower working section 115 (FIG. 10), arranged above the working region for the laying-in elements, and supports the lower run of the belt 105. Both ends of the working section 115 are adjoined by S-shaped sections 116 and 117, the other ends of which being connected to a return section 118, which is curved in the region of the drive wheels 106, 107 and straight in the upper section, and said section 118 supporting the belt 104.

As in the embodiment according to FIG. 1, the outer surfaces of the belts 104 and 105 are fitted with pawls 120, which lie against the sections of the yarn guides 9, gliding in the tubular guide rails, thereby entraining said guides 9. The S-shaped sections 116 and 117 represent transfer points for diverting the yarn guides 9 from the belt 104 to belt 105 and vice versa.

Figure 11:
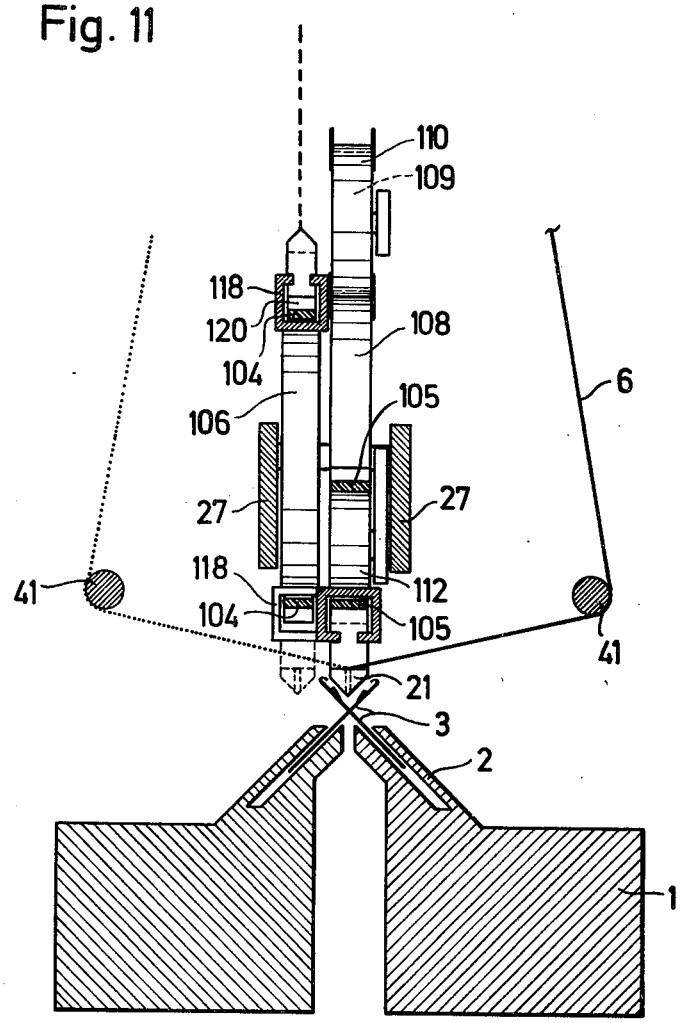
FIG. 11 shows a section along the line XI—XI of FIG. 10.

The mode of operation of the embodiment according to FIGS. 10 and 11 is analogous to that of embodiment according to FIG. 3, i.e., the yarn sections located between the yarn guides 9 and the eyelets 5, are diverted via the shunt 59, alternately to the one or other side of the rotary track. When moving in the direction of the arrow T, a yarn guide 9 reaches the section 116, is moved through this section at right angles to the transport direction from the belt 104 on to the belt 105, and then moves at a relatively slow speed through the working section 115. At the end of the working section, this yarn guide then runs into the section 117 and is pushed from this by the belt 105 back on to the belt 104, so that it is returned at greater speed back to the start of the working section.

Figure 12:
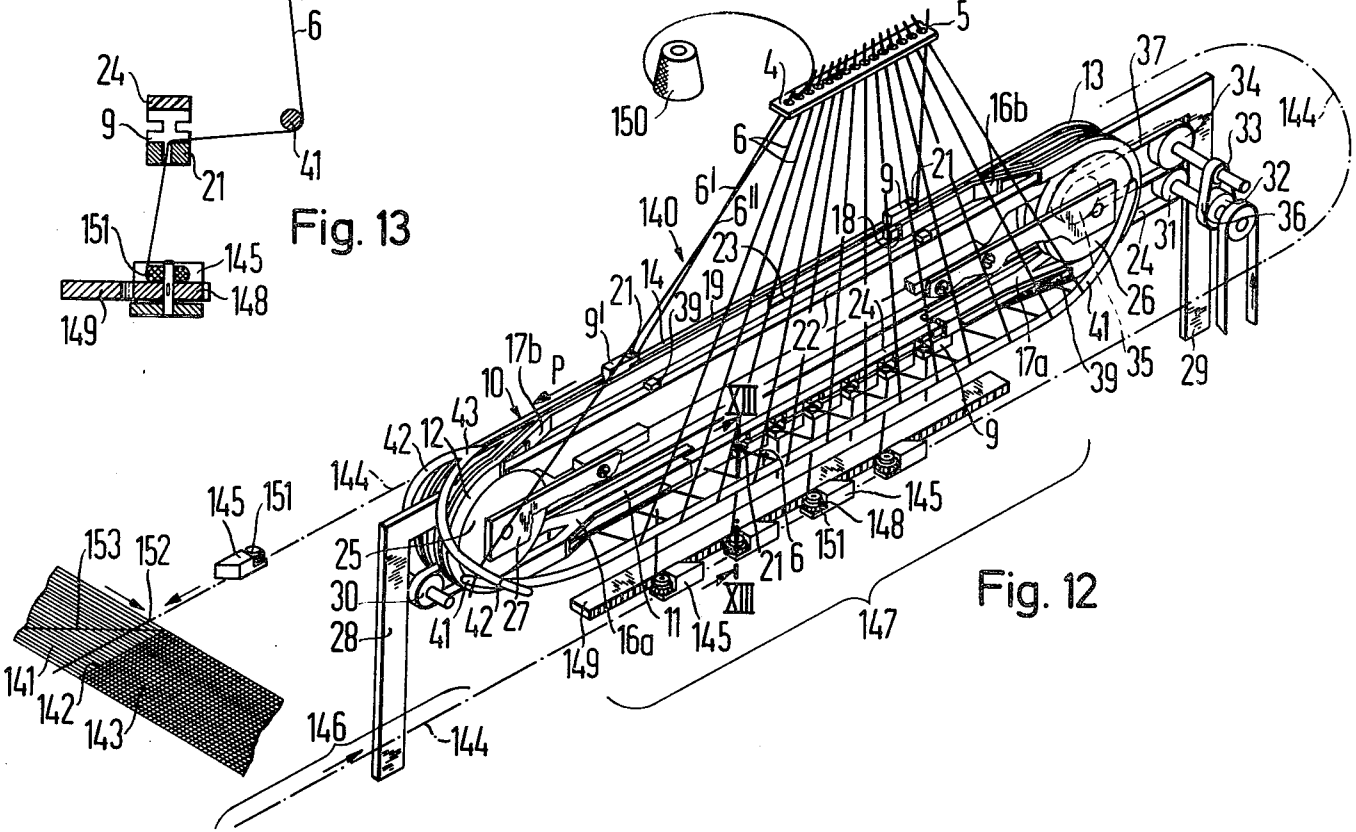
FIG. 12 is a schematic view in perspective, showing the use of the yarn guide system according to FIG. 1 on an undulating shed weaving machine.
Figure 13:
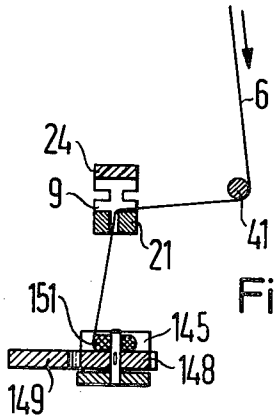
FIG. 13 is a section along the line XIII—XIII of FIG. 12.

FIGS. 12 and 13 show the application of the yarn guide system according to the invention on a known undulating-shed weaving machine (e.g. Dt.OLS 24 50 020). The yarn guide system according to FIG. 1 in this case, represents a winding station, designated by 140 as a whole, and this winding station is arranged alongside the weaving machine, of which only the warp threads 141, the reed beat-up 142, the cloth 143 and the shuttles 145, rotating on a transport chain 144 are depicted.

After passing through a return section 146 of the transport chain 144, the shuttles 145 arrive in a winding section 147 associated with the working section 11, and this winding section 147 also establishes the working region on which the laying-in elements 21 have to be guided, in order that the winding process can proceed in the desired manner, in particular, as illustrated in FIG. 13. In the winding section 147, a sprocket 148, provided on every shuttle 145 engages with a stationary ratchet 149, as a result of which, a package 151, connected coaxially with the sprocket 149, is driven and a length of weft yarn, corresponding to the weaving width of the weaving machine, is withdrawn from a stationary supply package 150. At the end of the winding section 117, where the sprocket 148 runs off the ratchet bar 149, this process is ended.

In known manner, each shuttle 145 enters the shed 143 at the point 152. The weft thread is then released from the bobbin 151 during the weft insertion; the weft thread is inserted in the shed 143 and beaten up by reed rods to the stop 142 in undulating form, corresponding to the shuttle motion. The weft thread grippers, e.g. clamps, and also the weft thread cutting elements, e.g. cutters, are not illustrated in FIG. 12. These are known features.

Alternatively, the bobbins 151 may be held firm and wound-up by means of a rotating weft winding arm (cf. for example, Dt. AS 23 32 440).

Figure 14:
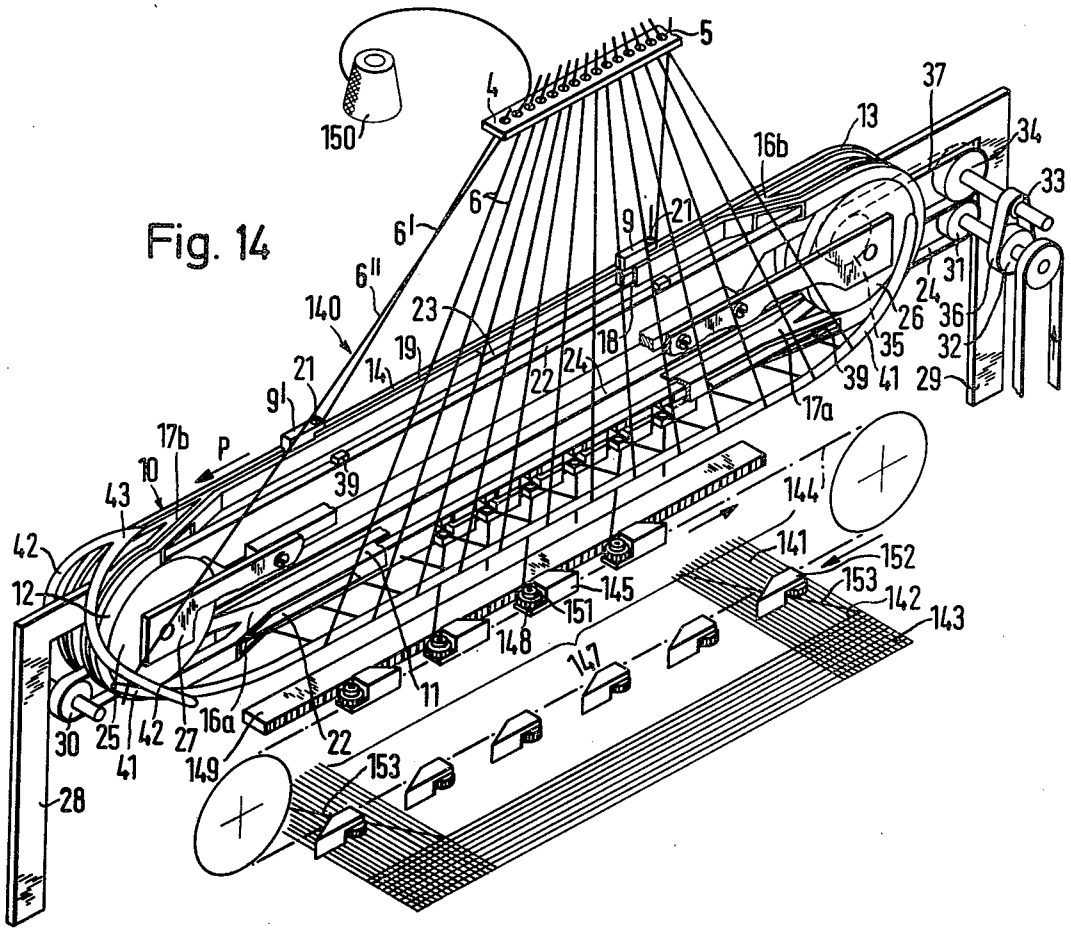
FIG. 14 shows a schematic diagram in perspective of the use of the yarn guide system as per FIG. 1 on an undulating shed weaving machine, according to another embodiment.

According to FIG. 14, the yarn guide system or winding station 140, according to the invention, may also be arranged directly above the weaving machine. With such an arrangement, there is the advantage on the one hand that only slightly more space is required than that needed for the weaving machine itself. On the other hand, one can dispense with th return transport section 116 and the now superfluous transport section lying between the end of the winding section 147 and the fabric 143, thereby affording the advantage that as many supply packages 150 can be saved as there would be shuttles 145 on the transport sections being dispensed with.

The invention is not limited to the described embodiment examples, but can in fact be modified in various ways. This applies in particular to the yarn guides, to the yarn clamps provided for these guides to the cutting devices, necessary for cutting the yarns at the end of the working region, and which are basically known from the cited German OLS 20 64 227, 23 51 741, 25 31 762 and 24 50 020 and also the DAS 23 32 440, and the mechanisms for diverting the yarn guides, yarns and rocking levers. Moreover, the systems, described in particular in conjunction with FIGS. 1, 3, 6 and 10 may be combined by various ways and means, with specific reference to the supporting of the rotary track and the means for altering the transport speed.

Moreover, the invention is not limited to specific slots in the circular discs and/or flanged discs, running parallel to the axes of the circular discs. In particular, the slots in the circular discs run preferably at an angle to the axes of the circular discs, such that the slots, are always covered by the support rolls when one support roll runs over the region of a circular disc provided with a slot, so that even when using a support construction in which the circular discs are mounted in suspension only by means of support rolls, a smooth hand uniform running of the support rolls over the circular discs is ensured. For the same purpose and in cases where each deflector wheel is made up of two parallel circular discs, the two circular discs are tangentially displaced or the two support rolls are so displaced to each other in tangential direction, that always only the one support roll will be in the region of a slot.

For such purposes of the invention, it is not essential to have a specific yarn storage element 7 (FIG. 3). Instead of the schematically illustrated spring storage means, pneumatic storage means or storage means in the form of a block and tackle pulley system may be used. However, all storage means should be designed such that either the stored yarn section is used up when the associated laying-in elements enter the working region, or that other means ensure that the yarn tension required for withdrawing the yarns from the supply packages, is not influenced by the storage device.

Moreover, the invention is not limited to the described means for preventing entwining of the yarns. For example, it is not necessary to have the yarn guides and the laying-in elements running on the same rotary track. The yarn guides and the laying-in elements in fact constitute two systems, which are interdependent only in as much as the yarn guides have the task of preventing entwining of the yarns, either on their own account or in conjunction with other means, whereas the laying-in elements serve to lay-in the yarns into the elements provided, whenever the yarn guides are in the working section of their rotary track. It is also possible therefore, to have the laying-in elements and the yarn guides rotating on separate tracks, such that the laying-in elements pick up the yarns always only just before entering the working region and releasing the yarns again after passing through the working region.

Nor is the invention limited to the fact that the yarn guide eyelet carrier or the line drawn through the eyelets and the working region or the working section are arranged essentially mutually parallel to each other, although the angle existing between the eyelet carrier and the working section should not exceed a value, dependent on the number of existing yarn guides, since otherwise, the yarns would make mutual contact when the relevant yarn guides pass through the working section, and this should be avoided.

Accordingly, the circular track need not be arranged in essentially one plane nor in a plane running thrugh the working section or working region and the eyelets.

The invention can in fact be used on other textile machines (cf. for example, Japanese patent (open for inspection) Sho 49-27659).

Figure 15:
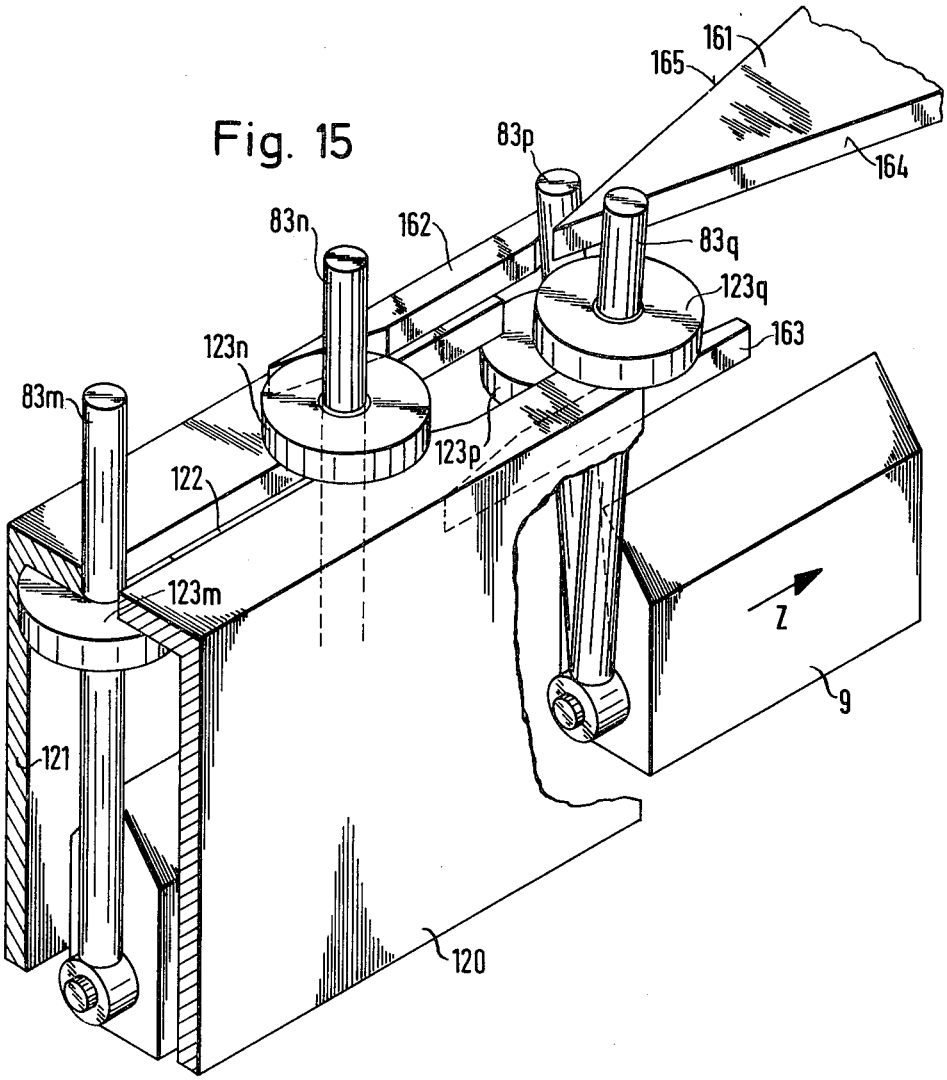
FIG. 15 shows details of another embodiment of the shunt arrangement.

Instead of the mechanism illustrated in FIG. 8, one can use the device showm in FIG. 15, in which the same components bear the same numbering. In the region of the branching, this mechanism involves only one deflector element 161, which, regardless of whether the storage elements 123 are in the upper or lower positions, acts on the rocking lever 83 at a position lying above the storage element 123. Upstream of the deflector element 161, provision is made for two selector rails 162, 163, with one of the rails 162 being at a level corresponding to the position of the storage elements 123 being guided above the guide groove 122, while the other selector rail 163 is at a height corresponding to the position of the storage elements 123 being guided beneath the guide groove 122.

When the yarn guides move in the direction of the arrow z, all the storage devices, e.g. the storage device **123*n*, located above the guide groove 122, run on to the selection rail 162, as the result of which the corresponding rocking levers 83, e.g. the rocking lever 83*n*, will be tilted to the right, thereby making it possible for the guide groove 122 to be broader in this region. The tilting of the rocking levers 83 is effected to a greater angle such that the rocking levers (as illustrated in FIG. 15 for the rocking lever 83*q*) run on to the front sliding surface 164 of the deflector element 161. All the storage elements 123, e.g. the storage element 123*m*, located beneath the guide groove 122, will however be tilted to the left by the selection rail 163 in FIG. 15, so that the associated rocking levers will also be tilted to the left and hence run on to the rear gliding surface 615 of the deflector element (FIG. 15), as illustrated in FIG. 15 for the rocking lever 83*p***.

The apparatus according to FIG. 15 has the advantage that the deflector element 161 acts only on the rocking levers 83, which means that the rocking levers 83 need to be tilted by the selection rails 162 and 163 through only a small angle, thereby making for more reliable selection. The selection by means of selection rails 162 and 163 has the further advantage that the rocking levers 83 run smoothly on to the sliding surfaces 164 and 165 and there is no danger that the rocking levers 83 or the storage elements 123 can become jammed or damaged during the selection process.

We claim:

1. Apparatus for feeding yarn, sliver or fibrous materials wound on stationary supply packages to a textile machine, comprising a plurality of movable material transporting elements and a plurality of movable material laying-in elements for feeding the materials from the supply packages to the textile machine, endless tracks defining working and return sections for said transporting elements and working and return regions for said laying-in elements, said transporting elements and said laying-in elements running in series on said endless tracks, and means for avoiding entwining of the materials during successive runs of said elements on said tracks having at least one deflection element by means of which the materials are fed via said transporting elements to said laying-in elements, during successive runs thereof through the working region, alternately from one and another side of a surface laid through the working region of said laying-in elements and the return section of said transporting elements.

2. Apparatus according to claim 1, wherein guiding means are provided for said materials, and the track for said transporting element is an O-shaped track having its return section arranged in a space between its working section and said guiding means, and said deflection element is designed and arranged such that said materials are fed to the laying-in elements alternately from the one and the other broad side of said O-shaped track.

3. Apparatus according to claim 2, wherin said O-shaped track is defined by at least two wheels having shafts mounted at the ends of at least one rigid rail.

4. Apparatus according to claim 2, wherein each wheel comprises at least one circular disc, and a coaxial drive wheel is attached to said disc for driving said transporting elements.

5. Apparatus according to claim 2, wherein said laying-in elements are combined with said transporting elements.

6. Apparatus according to claim 5, wherein said transporting elements are thread feeders each having a laying-in element.

7. Apparatus according to claim 2, wherein said O-shaped track has a single path for the transporting elements, and at least one frame is provided for floatingly mounting the track.

8. Apparatus according to claim 29, wherein said O-shaped track has at least one section having two paths for the transporting elements for providing at least one mounting location for rigidly mounting the track.

9. Apparatus according to claim 8, wherein there is provided one connection point of the two-path section with the working section and for the return section comprising a branch section for diverting the transporting elements alternately to one or the other path of the two-path section, and another connection point of the two-path section with the working section and the return section comprising a branch whereby the transporting elements entering from either of the paths of the two-path section can be diverted to the working or to the return section.

10. Apparatus according to claim 8, wherein there is provided at least two endless flexible belts arranged in parallel for driving the transporting elements.

11. Apparatus according to claim 10, wherein shunts are provided designed as transfer points for diverting the transporting elements from one belt to another belt.

12. Apparatus according to claim 10, wherein there is provided at least one flexible belt arranged in the working and/or return section for driving the transporting elements.

13. Apparatus according to claim 12, wherein said O-shaped track is defined by at least two wheels having shafts mounted at the ends of at least one rigid rail, and shunts are provided designed as transfer points for diverting the transporting elements from the belt to the wheels or from the wheels to the belt.

14. Apparatus according to claim 1, wherein means is provided for moving the transporting elements at different speeds.

15. Apparatus according to claim 3, wherein said O-shaped track is further defined by a first flexible, endless belt supporting on said wheels and revolving at a first speed and a second endless flexible belt revolving at a second speed, and wherein before and after the working section of the track there is provided a shunt for transferring the transporting elements from the first to the second belt and/or from the second to the first belt whereby the transporting elements are arranged along the return section of the track on the first belt and along the working section on the second belt.

16. Apparatus according to claim 15, wherein said second belt is supported by at least two additional wheels having shafts mounted in the rail and in a space between the first said two wheels, and there is a transmission gear for drivingly coupling at least one of said additional wheels with one of the first said two wheels.

17. Apparatus according to claim 4, wherein there is provided an endless, flexible belt arranged in the working and in the return section for driving the transporting elements, said belt being longer than the track, and guide rails on each side of said track for guiding and transporting elements, said transporting elements having teeth on one side thereof, and there is further provided a transmission gearing having a pinion drivingly coupled with the drive wheel of one of said two wheels, said teeth engaging said pinion whereby the transporting elements on the working section are transported by the pinions with undulations of the belt at one speed and transported on the remaining sections through the drive wheel at a second speed.

18. Apparatus according to claim 8, wherein said two belts revolve at a first speed, and there is provided at least a third belt revolving at a second speed and shunts before and after the working section of the track for transferring the transporting elements from one of the first said two belts to said third belt or from said third belt to one of the first said two belts.

19. Apparatus according to claim 1, wherein preventing means are provided for preventing the materials coming into contact with any disruptive parts of the apparatus or the textile machine.

20. Apparatus according to claim 3, wherein guide rail systems are provided for preventing the materials coming into contact with any disruptive parts of the apparatus or the textile machine comprising two guide rails each having an end in the region of one of said two wheels whereby these two ends overlap and form a passage for the materials.

21. Apparatus according to claim 19, wherein said preventing means comprise rocking levers pivotally mounted to said transporting elements and which are pivotable at an angle to the track, said levers having guiding means at free ends thereof through which said materials pass, and means are provided for pivoting said levers.

22. Apparatus according to claim 21, wherein said guiding means at the free ends of said rocking levers comprise eyelets.

23. Apparatus according to claim 19, wherein said preventing means comprise tubular rocking levers pivotally mounted to said transporting elements and which are pivotable at an angle to the track, said levers having exit ends through which said materials pass.

24. Apparatus according to claim 1, wherein said deflection element comprises a directing means.

25. Apparatus according to claim 24, wherein said directing means comprises a branch for the transporting elements, and means are provided for automatically controlling the passage of every transporting element through the branch.

26. Apparatus according to claim 21, wherein there are two deflection elements for tilting said rocking levers, each rocking lever having a storage device which can be set for one of two conditions prior to every passage at the two deflection elements, whereby the storage device is alternately placed in the region of one or the other of said deflection elements and each rocking lever is tilted alternately to one or the other side of the track.

27. Apparatus according to claim 21, wherein said means for pivoting said levers comprise two selection rails, and each rocking lever has a storage device which can be set to one of two conditions prior to every pass at the pivoting means, whereby the storage device is alternately placed in the range of one or the other of said selection rails and each rocking lever is alternately tilted by the deflection element to one or the other side of the track.

* * * * *